US011408640B2

(12) United States Patent
Hu et al.

(10) Patent No.: US 11,408,640 B2
(45) Date of Patent: Aug. 9, 2022

(54) HOUSING ASSEMBLY AND WATER HEATER

(71) Applicants: GREE ELECTRIC APPLIANCES (WUHAN) CO., LTD, Wuhan (CN); GREE ELECTRIC APPLIANCES, INC. OF ZHUHAI, Zhuhai (CN)

(72) Inventors: Chuxin Hu, Zhuhai (CN); Wenyan Zhong, Zhuhai (CN); Guangyue Li, Zhuhai (CN); Ruchun Zhao, Zhuhai (CN); Jiangtao Song, Zhuhai (CN)

(73) Assignees: GREE ELECTRIC APPLIANCES (WUHAN) CO., LTD, Hubei (CN); GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 0 days.

(21) Appl. No.: 16/763,445

(22) PCT Filed: Aug. 20, 2018

(86) PCT No.: PCT/CN2018/101313
§ 371 (c)(1),
(2) Date: May 12, 2020

(87) PCT Pub. No.: WO2019/095761
PCT Pub. Date: May 23, 2019

(65) Prior Publication Data

US 2020/0318856 A1 Oct. 8, 2020

(30) Foreign Application Priority Data

Nov. 20, 2017 (CN) ..... 201711160980.1

(51) Int. Cl.
*F24H 9/00* (2022.01)
*F24H 9/06* (2006.01)
*F28F 9/02* (2006.01)

(52) U.S. Cl.
CPC ..... *F24H 9/0005* (2013.01); *F24H 9/06* (2013.01); *F28F 9/0226* (2013.01); *F28F 2275/122* (2013.01); *Y10T 29/4935* (2015.01)

(58) Field of Classification Search
CPC ..... F22B 37/24; F22B 37/242; F24H 9/06; F24H 9/02; F24H 9/14; F24H 9/146;
(Continued)

(56) References Cited

U.S. PATENT DOCUMENTS 2,084,481 A * 6/1937 Davis ..... F24H 9/06 126/305
2,491,700 A * 12/1949 Zwerling ..... F16L 23/14 248/58

(Continued)

FOREIGN PATENT DOCUMENTS

CN 202709468 U 1/2013
CN 204757382 U * 11/2015

(Continued)

OTHER PUBLICATIONS

International Search Report for corresponding International App. No. PCT/CN2018/101313, dated Nov. 6, 2018, 2 pages.

(Continued)

*Primary Examiner* — Michael G Hoang
*Assistant Examiner* — Andrew W Cheung
(74) *Attorney, Agent, or Firm* — Armstrong Teasdale LLP

(57) ABSTRACT

Provided are a housing assembly and a water heater. The housing assembly includes a bottom plate assembly and an outer housing. The outer housing is provided with a hooking fitting portion, the bottom plate assembly includes: a base and a supporting portion, a crimping space for positioning the outer housing is formed between at least portion of the supporting portion and the base. The hooking fitting portion is hooked with the crimping space.

16 Claims, 6 Drawing Sheets

(58) Field of Classification Search
CPC ... F24H 9/148; F28F 2225/00; F28F 2225/02; F28F 2230/00; F28F 2275/08; F28F 2275/085; F28F 2275/122; F28F 2280/04; B29C 66/54
USPC ..... 220/309.1, 694.1; 70/158; 292/256.6; 29/410; 122/234, 19.2, 494
See application file for complete search history.

(56) References Cited

U.S. PATENT DOCUMENTS 2,963,194 A * 12/1960 Brennan ..... B65D 71/502 220/23.83
3,921,848 A * 11/1975 Dolveck ..... B65D 7/36 220/620
4,351,390 A * 9/1982 Argyle ..... F28F 9/0226 165/149
4,452,226 A * 6/1984 Daugirda ..... F24H 9/06 122/494
4,645,002 A * 2/1987 Keyzer ..... F28F 9/0226 165/175
7,765,959 B2 * 8/2010 Syler ..... F24H 1/182 122/19.2
8,771,156 B2 * 7/2014 Chen ..... F16B 2/08 482/148
9,541,304 B2 * 1/2017 Rissler ..... F24H 9/02
2008/0050206 A1 * 2/2008 Kwakkel ..... B21D 51/30 413/1
2009/0200321 A1 * 8/2009 Oohori ..... B21D 51/32 220/619
2014/0158697 A1 * 6/2014 Tarr ..... F24H 9/17 220/571
2015/0233654 A1 * 8/2015 Farlow ..... F28F 9/0226 165/173

FOREIGN PATENT DOCUMENTS

CN 204757382 U 11/2015
JP 2016011789 A 1/2016
WO 2015019632 A1 2/2015

OTHER PUBLICATIONS

Supplementary European Search Report for corresponding European Appl. No. 18878027, dated Jul. 15, 2021, 8 pages.

* cited by examiner

HOUSING ASSEMBLY AND WATER HEATER

CROSS-REFERENCE TO RELATED APPLICATIONS

The present application is a national stage entry of International Patent Application No. PCT/CN2018/101313, filed on Aug. 20, 2018, and claims priority to Chinese patent application No. 201711160980.1, filed on Nov. 20, 2017, the contents of which are hereby incorporated by reference in their entirety.

TECHNICAL FIELD

The disclosure relates to the technical field of assembling a water heater, in particular to a housing assembly and a water heater.

BACKGROUND

An outer housing of a water tank of an air energy water heater shall be fixedly connected to a bottom plate and a top cover in some way to form a closed space, and then shall be foamed to form an insulated water tank. According to the existing structural form, a structure of the outer housing is generally a columnar surface, a lower end of the outer housing is further processed to assemble with the bottom plate that is close to a circular plane structure; an annular part is further supplemented. An end part of the outer housing is clamped between the bottom plate and the annular part. The bottom plate is fixedly connected to the annular part, thus to fixedly connect the housing to the bottom plate.

Since the end of the outer housing with the structural form like this is an arc shape, while the assembling surface of the bottom plate with the outer housing and the assembling surface of the annular part with the outer housing are flat surfaces or close to flat surface; the contacts between the outer housing and the bottom plate and between the outer housing and the annular part are actually line contacts, so it leads that: firstly, the sealing effect is not good, so the foaming effect is affected, it is not in favor of performance and appearance; secondly, an assembly body formed by the outer housing and the bottom plate and the annular part has small rigidity on radial direction, it is not in favor of the integral reliability; and thirdly, the positioning is difficult when assembling, thus the assembling precision and production efficiency are reduced.

SUMMARY

The main objective of some embodiments of the disclosure is to provide a housing assembly and a water heater, in order to solve the problem that the housing assembly in a related technology has low assembling reliability.

In order to achieve the above objective, according to one aspect of the disclosure, a housing assembly is provided, which includes a bottom plate assembly and an outer housing. The outer housing is provided with a hooking fitting portion. The bottom plate assembly includes a base and a supporting portion. A crimping space for positioning the outer housing is formed between at least one portion of the supporting portion and the base. The hooking fitting portion is hooked with the crimping space.

In an exemplary embodiment, the base is provided with a groove for accommodating the outer housing, a slot wall of the groove is used as a stopping surface for preventing the outer housing from slipping.

In an exemplary embodiment, the stopping surface is arranged in an inclined way opposite to the bottom surface of the groove to guide when installing the outer housing.

In an exemplary embodiment, the supporting portion is provided with a connection bump, and the connection bump is hooked with the hooking fitting portion of the outer housing.

In an exemplary embodiment, a crimping space is formed between the connection bump and the slot wall of the groove.

In an exemplary embodiment, the hooking fitting portion is a hook on an end of the outer housing, and the hook is hooked with the connection bump.

In an exemplary embodiment, a slot wall surface of the groove opposite to the stopping surface is a supporting surface, and a height of the supporting surface is greater than a height of the connection bump to support the supporting portion.

In an exemplary embodiment, the supporting portion is provided with a crimping end and a supporting end, a bottom end of the supporting end is level to a bottom end of the base, and the connection bump is arranged on the crimping end.

In an exemplary embodiment, a positive projection of the supporting portion on the bottom plate assembly includes a first side projected by the supporting end and a second side projected by the crimping end, and the first side and the second side have the same radius of curvature.

In an exemplary embodiment, the supporting portion is further provided with a first positioning structure, and the base is further provided with a second positioning structure that is positioned and matched with the first positioning structure.

In an exemplary embodiment, the first positioning structure is a positioning convex column, and the second positioning structure is a positioning hole, the positioning convex column is inserted in the positioning hole.

In an exemplary embodiment, the base is a cyclic structure, and an inner cyclic surface of the base is provided with a convex rib, the supporting portion is provided with a demising recess that is adapted with the convex rib in shape.

In an exemplary embodiment, the housing assembly is a water tank.

According to the other aspect of the disclosure, a water heater is provided, which includes the abovementioned housing assembly.

With the application of the technical solution in the disclosure, the housing assembly is composed of two parts: a bottom plate assembly and an outer housing. The bottom plate assembly includes a base and a supporting portion, a concavo-convex crimping space is arranged between the base and the supporting portion, an end of the outer housing of the housing assembly is provided with a hooking fitting portion, to position the outer housing into the crimping space for positioning and fixing the outer housing, so that a firm clamping structure is formed between the outer housing and the base and the supporting portion, thus to ensure the positioning accuracy of the outer housing, and to improve the reliability of the housing assembly. Therefore, the supporting portion is adjusted flexibility and mounted without blocking, the assembly is more easily positioned, and the assembling efficiency is higher.

BRIEF DESCRIPTION OF THE DRAWINGS

The accompanying drawings constituting a part of the present application are used for providing further understanding to the disclosure. Schematic embodiments of the disclosure and description thereof are used for illustrating the disclosure and not intended to form an improper limit to the disclosure. In the accompanying drawings.

Herein, the above accompanying drawings include appended reference numbers as follows.

10—base; 11—groove; 12—stopping surface; 13—second positioning structure; 14—convex rib; 15—supporting surface; 20—supporting portion; 21—connection bump; 22—crimping end; 23—supporting end; 24—first positioning structure; 25—demising recession; 30—outer housing; 40—bottom plate assembly.

DETAILED DESCRIPTION OF THE EMBODIMENTS

It should be noted that the embodiments of the present application and features of the embodiments may be mutually combined without conflicts. The present application will be elaborated below in detail with reference to the accompanying drawings and in combination with the embodiments.

It should be noted that unless otherwise definitely indicated, all technical and scientific terms adopted by the present application are the same meaning generally understood by ordinary skill in the art of the present application.

In the disclosure, under the premise without contrary explanation, the adopted orientation words "upper", "lower", "top", "bottom" and the like generally refer to the directions indicated by the accompanying drawings, or refer to the parts on upright, vertical or gravity directions. Similarly, in order to conveniently understand and describe, terms "inner, outer" refer to inside and outside of outlines of all parts, but the above orientation words are not adopted to limit the disclosure.

In order to solve the problem that the housing assembly in a related technology has low assembling reliability, the disclosure provides a housing assembly and a water heater. The water heater is an air energy water heater, and the water heater includes a housing assembly, which is the housing assembly as follows.

Figure 1:
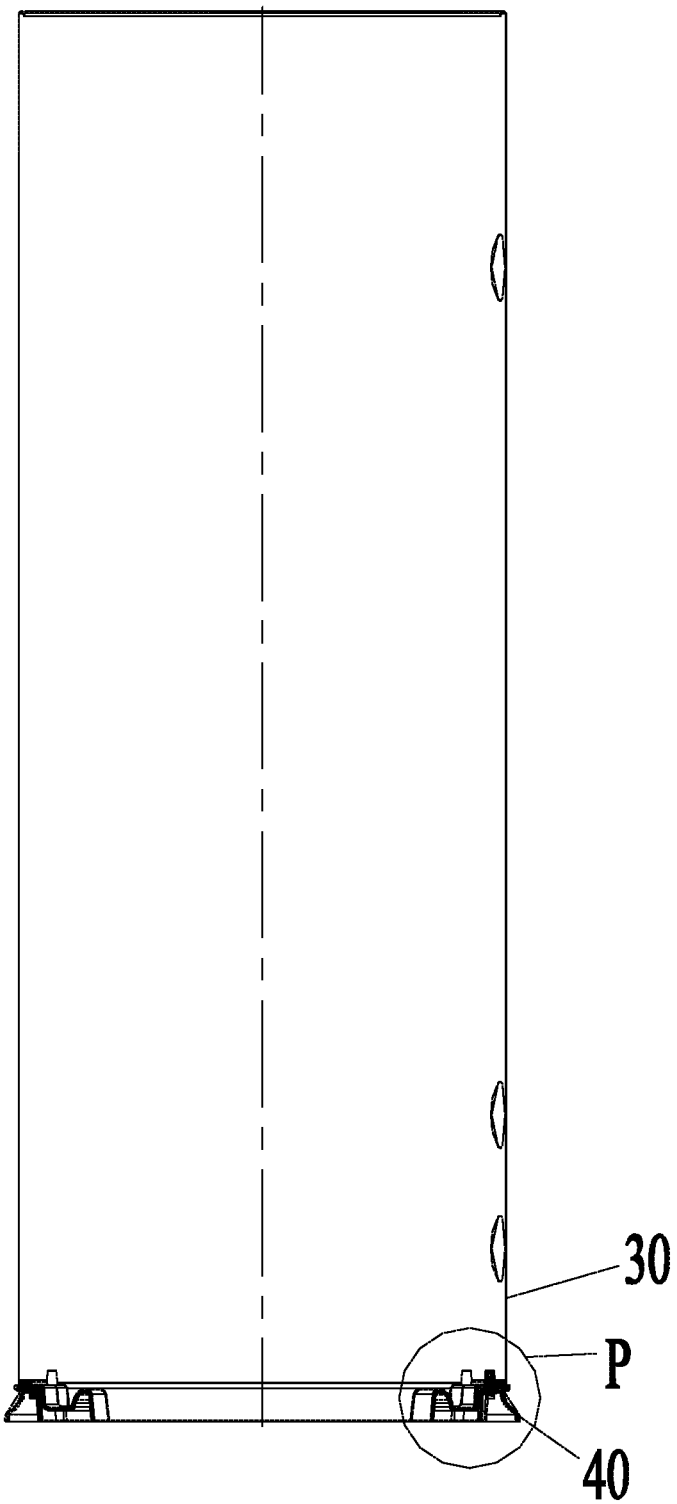
FIG. 1 is a front view of a water heater according to the disclosure.
Figure 2:
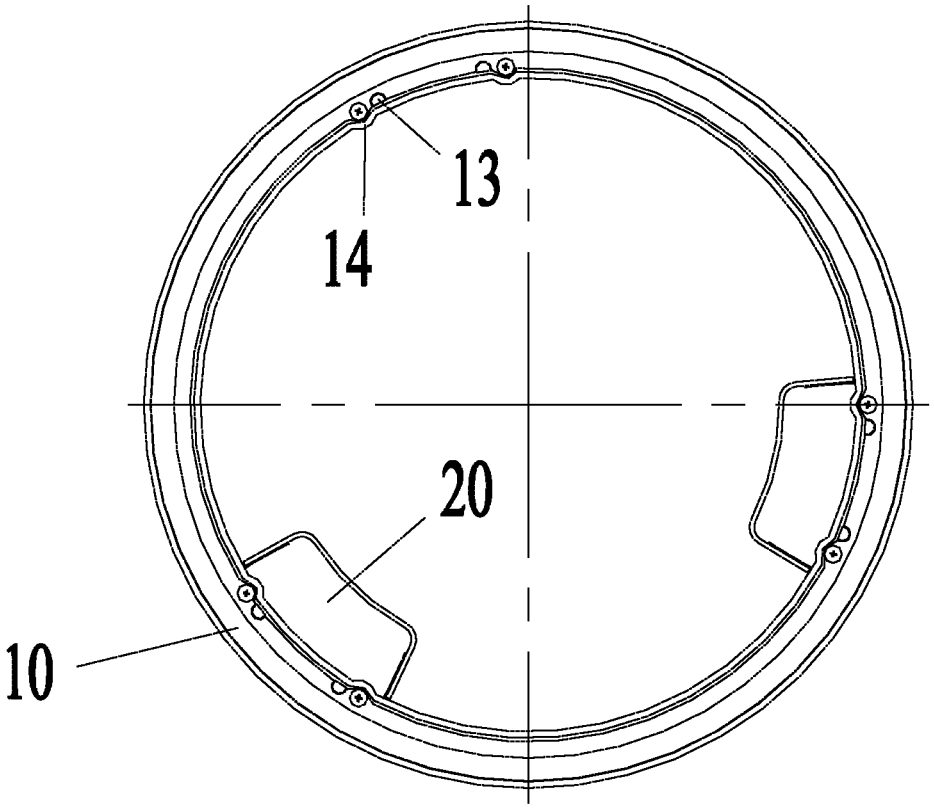
FIG. 2 is an upward view illustrating a water heater in FIG. 1.
Figure 3:
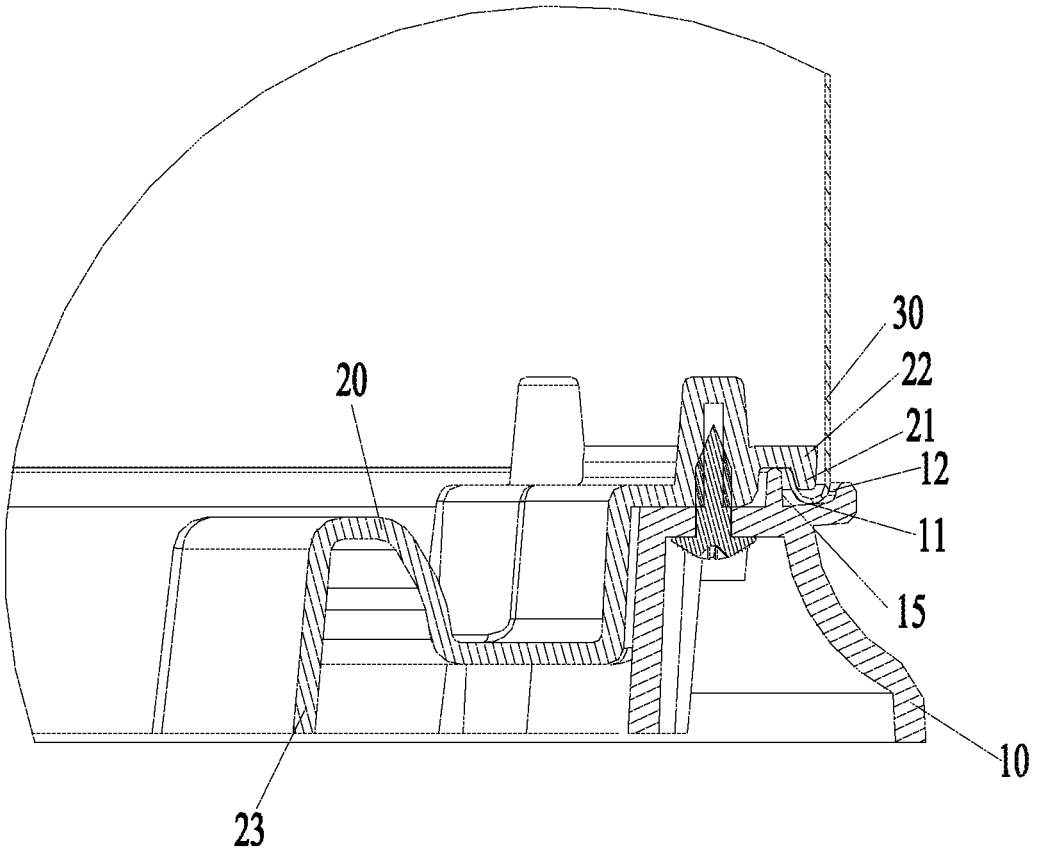
FIG. 3 is an enlarged drawing illustrating a position P of a water heater in FIG. 1.
Figure 4:
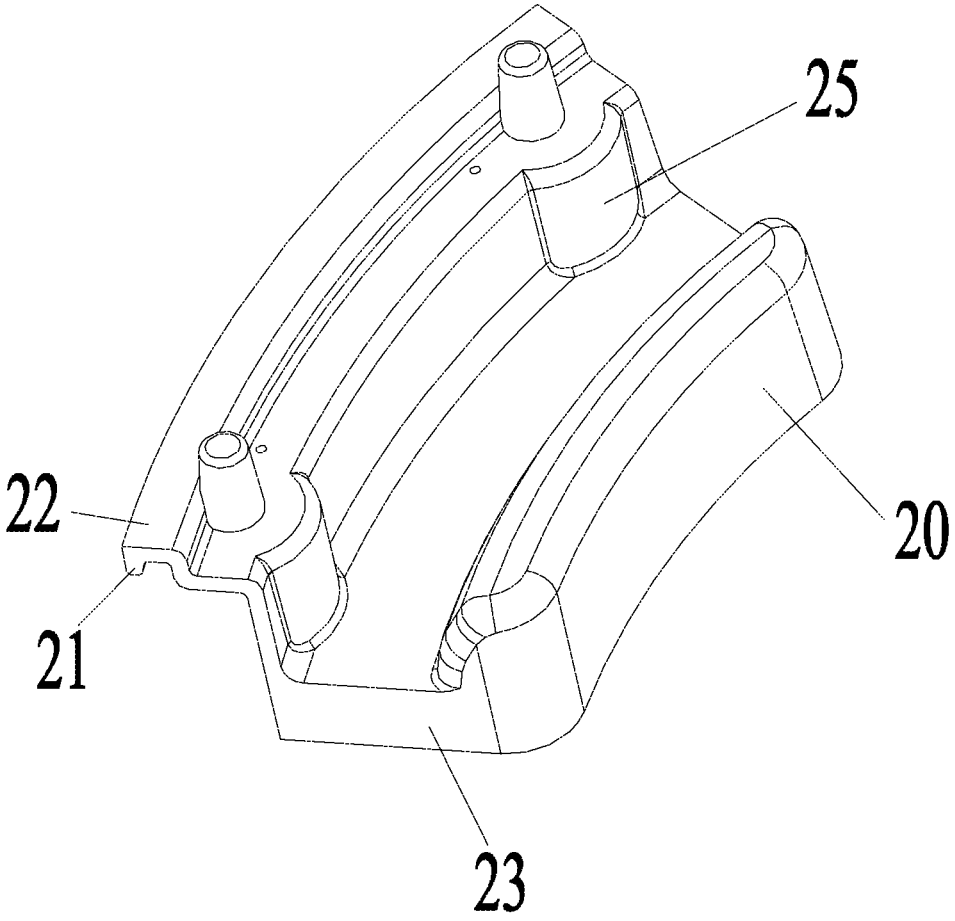
FIG. 4 is a structural schematic diagram illustrating a structure of a supporting portion of a water heater in FIG. 1.
Figure 5:
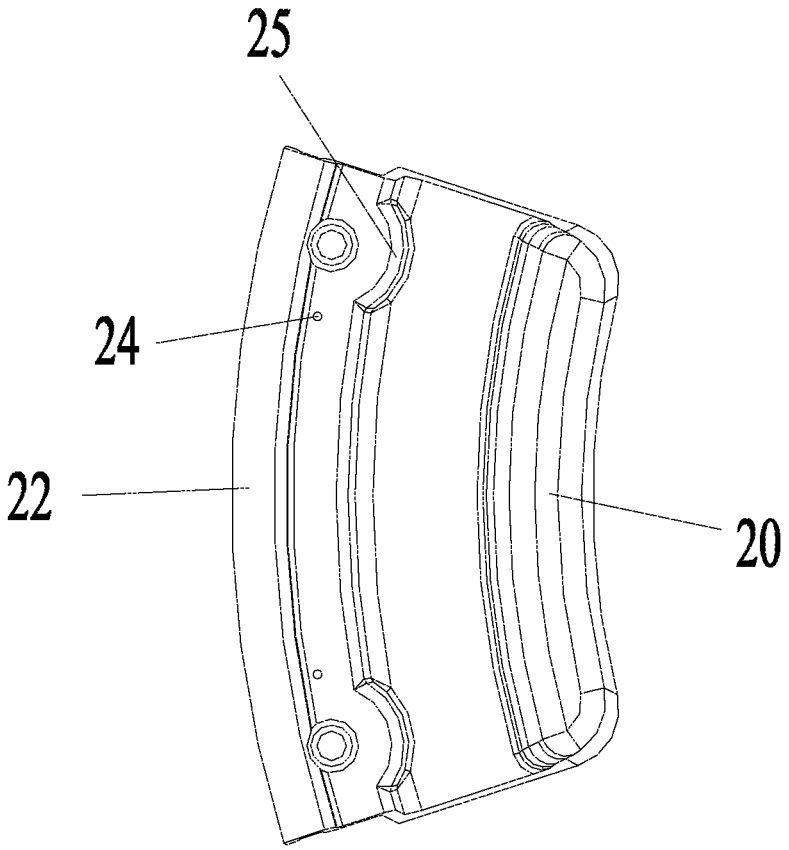
FIG. 5 is an upward view illustrating a supporting portion in FIG. 4.
Figure 6:
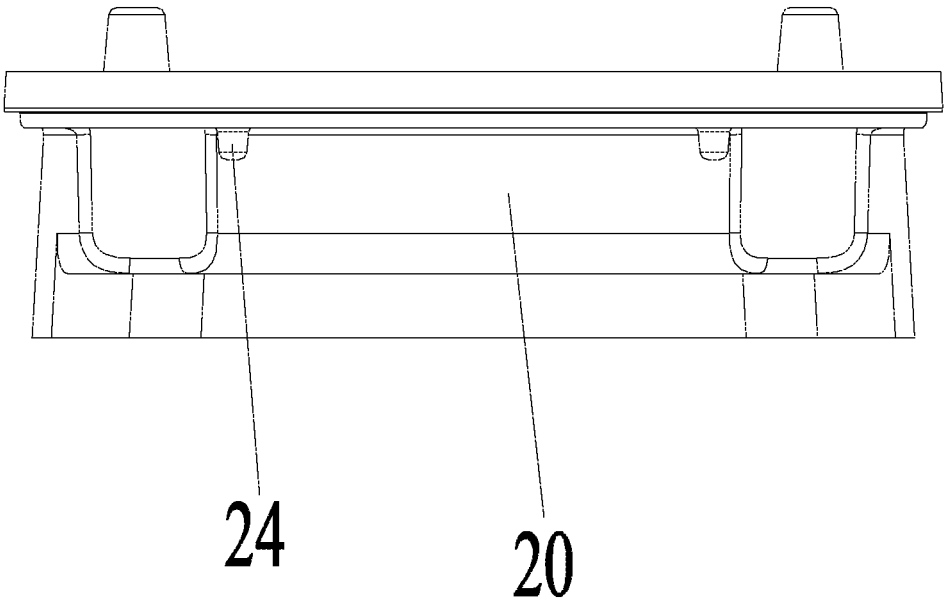
FIG. 6 is a left view illustrating a supporting portion in FIG. 4.

A housing assembly as shown in FIG. 1 to FIG. 3 includes a bottom plate assembly 40 and an outer housing 30. The outer housing 30 is provided with a hooking fitting portion, and the bottom plate assembly 40 includes a base 10. A supporting portion 20 is further provided. A crimping space for positioning the outer housing 30 is formed between at least portion of the supporting portion 20 and the base 10. The hooking fitting portion is hooked with the crimping space.

Specifically, the housing assembly is composed of two parts: the bottom plate assembly 40 and the outer housing 30. The bottom plate assembly 40 includes the base 10 and the supporting portion 20. The concavo-convex crimping space is arranged between the base 10 and the supporting portion 20. An end of the outer housing 30 of the housing assembly is provided with the hooking fitting portion, to position the outer housing 30 in the crimping space for positioning and fixing the outer housing 30, so that a firm clamping structure is formed between the outer housing 30 and the base 10 and supporting portion 20, thus to ensure the positioning accuracy of the outer housing 30, and to improve the reliability of the housing assembly. Therefore, the supporting portion 20 is adjusted flexibility and mounted without blocking, the assembly is more easily positioned, and the assembling efficiency is higher.

Optionally, the base 10 is provided with a groove 11 for accommodating the outer housing 30, a slot wall of the groove 11 is used as a stopping surface 12 for preventing the outer housing 30 from slipping.

Preferably, the base 10 is provided with the groove 11. Some or all of a hook of the outer housing 30 is accommodated in the groove 11 to initially position the outer housing 30. Meanwhile, the side slot wall of the groove 11 is used as the stopping surface 12 for stopping the outer housing 30, to form a surface contact between the outer housing 30 and the base 10, thus to form a surface seal and enhance the sealing property therebetween, so that the water heater may perform the subsequent foaming process in a better way. Certainly, an additional sealing part is able to be added between the outer housing 30 and the base 10 for sealing.

In an exemplary embodiment, optionally, the stopping surface 12 is arranged in an inclined way opposite to the bottom surface of the groove 11 to guide when installing the outer housing 30.

Specifically, the stopping surface 12 is arranged in the inclined way opposite to the bottom surface of the groove 11, so the stopping surface 12 may guide the installation of the outer housing 30, it is convenient for installers to install, thus to improve installing efficiency.

Optionally, the supporting portion 20 is provided with a connection bump 21 extended toward the base 10, the connection bump 21 is hooked with the hooking fitting portion of the outer housing 30, and a crimping space is formed between the connection bump 21 and the slot wall of the groove 11.

Specifically, the supporting portion 20 is provided with the connection bump 21 matched with the groove 11 on the base 10, the space between the groove 11 and the connection bump 21 is the crimping space. The connection bump 21 is hooked with the outer housing 30 so that the supporting portion 20 can be clamped with the outer housing 30, thus further ensuring the reliability of connecting the outer housing 30 with the supporting portion 20 and the base 10. Meanwhile, there is only one degree of freedom between the outer housing 30 and the base 10 and the supporting portion 20, so the positioning among three parts is uniquely accurate.

In an exemplary embodiment, the hooking fitting portion is a hook on an end of the outer housing 30. The hook is hooked with the connection bump 21, to ensure the reliability of connecting the supporting portion 20 with the outer housing 30.

Optionally, one wall surface of the groove 11 opposite to the stopping surface 12 is a supporting surface 15, and a height of the supporting surface 15 is greater than a height of the connection bump 21 to support the supporting portion 20.

Specifically, one surface of the groove 11 opposite to the stopping surface 12 is the supporting surface 15. The supporting surface 15 is formed by a supporting column protruded toward the supporting portion 20 by the base 10, and the height of the supporting column is greater than a height of the connection bump 21, so that the supporting column may have a certain support to the supporting portion 20. Meanwhile, the connection bump 21 is prevented from over-extending into the hook to cause instable connection.

Optionally, the supporting portion 20 is provided with a crimping end 22 and a supporting end 23. A bottom end of the supporting end 23 is level to a bottom end of the base 10, and the connection bump 21 is arranged on the crimping end 22.

Specifically, in the present embodiment, the supporting portion 20 is a supporting plate, the supporting portion 20 is provided with the crimping end 22 and the supporting end 23. The connection bump 21 is arranged on the crimping end 22 to match with the groove 11 of the base 10. A bottom end of the supporting end 23 is level to a bottom end of the base 10, so the supporting portion 20 may share and reduce the pressure borne by the base 10, protect the base 10 from damage caused by squeezing, and improve the whole service life of the housing assembly.

As shown in FIG. 1 to FIG. 4, a positive projection of the supporting portion 20 on the bottom plate assembly includes a first side projected by the supporting end 23 and a second side projected by the crimping end 22, and the first side and the second side have the same radius of curvature.

Specifically, the supporting portion 20 is provided with the first side and the second side. The outer housing 30 of the water heater is generally circular, so that the supporting portion 20 is arranged into a structure with a certain radian. The first side and the second side have the same radius of curvature. Correspondingly, an installing position on the base 11 is further arranged into a circle having the same radius of curvature, so that the supporting portion 20 is able to be installed and fixed on the base 10.

As shown in FIG. 4 to FIG. 7, the supporting portion 20 is further provided with a first positioning structure 24, and the base 10 is further provided with a second positioning structure 13 that is positioned and matched with the first positioning structure 24.

Specifically, the supporting portion 20 is provided with the first positioning structure 24, the base 10 is provided with the corresponding second positioning structure 13. The first positioning structure 24 and the second positioning structure 13 may be mutually matched to form a mutual limitation, so that the supporting portion 20 may be uniquely and accurately installed on the base 10, it is convenient for installers to install, thus to improve installing efficiency.

In an exemplary embodiment, the first positioning structure 24 is a positioning convex column, and the second positioning structure 13 is a positioning hole, the positioning convex column is inserted in the positioning hole.

Specifically, the positioning convex column is protruded toward the direction of the base 10. The positioning hole may accommodate the positioning convex column, so that the positioning convex column may be inserted in the positioning hole, and one supporting portion 20 is provided with a plurality of positioning convex columns, to further limit the installing position of the supporting portion 20 on the base 10, and to ensure the installing accuracy. Certainly, the first positioning structure 24 may be arranged as a hook, which is convenient to connect when implementing the positioning effect, without connecting through additional bolts.

Figure 7:
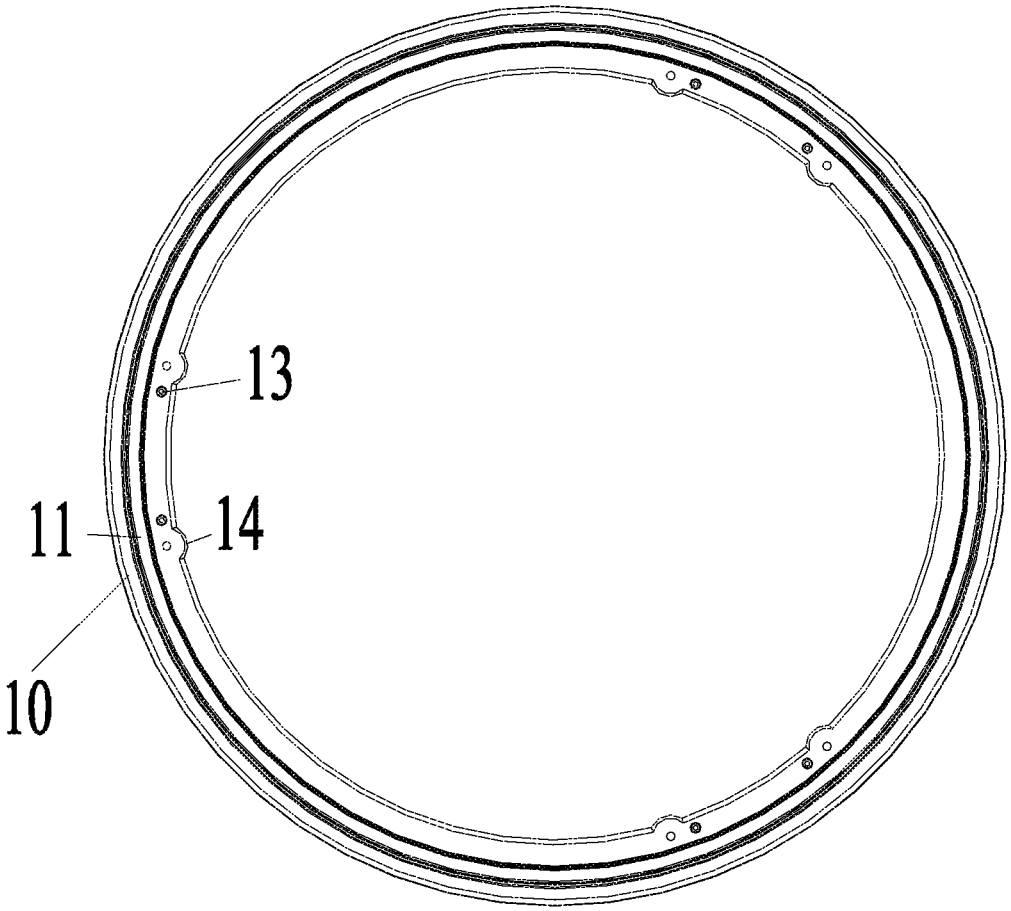
FIG. 7 is a top view illustrating a base of a water heater in FIG. 1.

As shown in FIG. 7, the base 10 is a cyclic structure, and an inner cyclic surface of the base 10 is provided with a convex rib 14, the supporting portion 20 is provided with a recess portion 25 that is adapted with the convex rib 14 in shape.

Specifically, the base 10 is a cyclic structure, so that the base 10 is matched with structure of the outer housing 30, to reduce the volume of the whole water heater. The inner surface of the base 10 is provided with the convex rib 14, which is a protruded arc structure. Correspondingly, the supporting portion 20 is provided with the recess portion 25 to match with the convex rib 14, so that the installer may initially limit the relative position between the supporting portion 20 and the base 10 through the structures of convex rib 14 and the demising recession 25 when installing the supporting portion 20 and the base 10, it is convenient for installers to install, thus to improve installing efficiency.

Optionally, in the present embodiment, the housing assembly is a water tank. The outer housing of the water tank may be firmly clamped on the bottom plate assembly, thus to increase the reliability of assembling water tank.

From the above description, it may be seen that the abovementioned embodiments of the disclosure realize the following technical effects.

Firstly, the embodiments of the disclosure solve the problem that the housing assembly in the related technology has low assembling reliability.

Secondly, the embodiments of the disclosure improve the contact between the outer housing 30 and the supporting portion 20 and form a surface contact between the outer housing 30 and the base 10, thus to increase the sealing effect, and may foam in a better way.

Thirdly, the assembly body in the embodiments of the disclosure has higher rigidity on radial direction, thus to have higher reliability and accurate location.

Fourthly, it is more convenient to assemble and position according to the embodiments of the disclosure, thus to improve the positioning accuracy and production efficiency;

Fifthly, the embodiments of the disclosure may have more elegant appearance.

It is apparent that the described embodiments are only a part of the embodiments of the disclosure, but not all. On the basis of the embodiment of the disclosure, all other embodiments obtained on the premise of no creative work of those skilled in the art should fall within the protection scope of the disclosure.

It should be noted that the terms adopted here are not intended to limit the exemplary implementing manners of the present application, but only to describe the specific implementing manners. For example, as for the terms adopted here, unless otherwise indicated additionally and clearly by context, the singular form is intended to include the plural form. In addition, it should be understood that when the specification uses terms "include" and/or "contain", it should indicate existing characteristics, steps, work, parts, assemblies and/or the combination thereof.

It should be noted that the specification and claims of the present application and terms "first", "second" and the like in the accompanying drawings are used for distinguishing similar objects rather than describing a specific sequence or a precedence order. It should be understood that the data used like this may be exchanged under appropriate circumstances, so that the embodiments of the present application described here may be implemented in an order different from that described or shown here.

The abovementioned embodiments are only the preferable embodiments of the disclosure, but not for limiting the disclosure. Those skilled in the art may make variations and modifications to the disclosure. Within the spirit and principle of the disclosure, any made variations, equal replacements, improvements and the like shall fall in the protection scope of the disclosure.

What is claimed is:

1. A housing assembly, comprising: a bottom plate assembly and an outer housing, the outer housing is provided with a hooking fitting portion, the bottom plate assembly comprises: a base; and a supporting portion, a crimping space for positioning the outer housing is formed between the supporting portion and the base, the hooking fitting portion is hooked with the crimping space, the base is provided with a groove for accommodating the outer housing, a slot wall of the groove is used as a stopping surface for preventing the outer housing from slipping, the supporting portion is provided with a connection bump extended toward the base, the connection bump is hooked with the hooking fitting portion of the outer housing, the supporting portion is provided with a crimping end and a supporting end, a bottom end of the supporting end is level to a bottom end of the base, the connection bump is arranged on the crimping end, the base is an annular structure, the supporting end is located inside an inner annular surface of the base;

wherein the hooking fitting portion is a hook that is integral to an end of the outer housing, and extending from the end of the outer housing, the hook is hooked with the connection bump.

2. The housing assembly as claimed in claim 1, wherein the stopping surface is arranged in an inclined way with respect to a bottom surface of the groove to guide when installing the outer housing.

3. The housing assembly as claimed in claim 1, wherein the crimping space is formed between the connection bump and the slot wall of the groove.

4. The housing assembly as claimed in claim 1, wherein a slot wall surface of the groove opposite to the stopping surface is a supporting surface, a height of the supporting surface is greater than a height of the connection bump to support the supporting portion.

5. The housing assembly as claimed in claim 1, wherein a positive projection of the supporting portion on the bottom plate assembly comprises a first side projected by the supporting end and a second side projected by the crimping end, and the first side and the second side have the same radius of curvature.

6. The housing assembly as claimed in claim 1, wherein the supporting portion is further provided with a first positioning structure, and the base is further provided with a second positioning structure that is positioned and matched with the first positioning structure.

7. The housing assembly as claimed in claim 6, wherein the first positioning structure is a positioning convex column, the second positioning structure is a positioning hole, the positioning convex column is inserted in the positioning hole.

8. The housing assembly as claimed in claim 1, wherein the inner annular surface of the base is provided with a convex rib, the supporting portion is provided with a recess portion that is adapted with the convex rib in shape.

9. The housing assembly as claimed in claim 1, wherein the housing assembly is a water tank.

10. A water heater, comprising the housing assembly as claimed in claim 1.

11. The housing assembly as claimed in claim 10, wherein the base is provided with a groove for accommodating the outer housing, a slot wall of the groove is used as a stopping surface for preventing the outer housing from slipping.

12. The housing assembly as claimed in claim 11, wherein the stopping surface is arranged in an inclined way with respect to a bottom surface of the groove to guide when installing the outer housing.

13. The housing assembly as claimed in claim 11, wherein the supporting portion is provided with a connection bump extended toward the base, the connection bump is hooked with the hooking fitting portion of the outer housing.

14. The housing assembly as claimed in claim 13, wherein the crimping space is formed between the connection bump and the slot wall of the groove.

15. The housing assembly as claimed in claim 13, wherein the hooking fitting portion is a hook on an end of the outer housing, the hook is hooked with the connection bump.

16. The housing assembly as claimed in claim 13, wherein a slot wall surface of the groove opposite to the stopping surface is a supporting surface, a height of the supporting surface is greater than a height of the connection bump to support the supporting portion.

* * * * *